US006802767B2

(12) United States Patent
Kanaya

(10) Patent No.: US 6,802,767 B2
(45) Date of Patent: Oct. 12, 2004

(54) LOCAL EXHAUSTING AND VENTILATING METHODS, AND LOCAL EXHAUSTING DEVICE AND LOCAL VENTILATING SYSTEM

(76) Inventor: Yoshiaki Kanaya, 72-1, Minamiikedacho, Iwakura, Sakyo-ku, Kyoto-shi, Kyoto (JP), 606-0005

( * ) Notice: Subject to any disclaimer, the term of this patent is extended or adjusted under 35 U.S.C. 154(b) by 0 days.

(21) Appl. No.: 10/240,830

(22) PCT Filed: Apr. 6, 2001

(86) PCT No.: PCT/JP01/03011

§ 371 (c)(1),
(2), (4) Date: Oct. 7, 2002

(87) PCT Pub. No.: WO01/77589

PCT Pub. Date: Oct. 18, 2001

(65) Prior Publication Data

US 2003/0162491 A1 Aug. 28, 2003

(30) Foreign Application Priority Data

Apr. 10, 2000 (JP) ..... 2000-107711

(51) Int. Cl.[7] ..... F24F 7/00
(52) U.S. Cl. ..... 454/49; 454/56; 126/299 F
(58) Field of Search ..... 454/49, 56, 58, 454/59; 126/299 F, 299 R, 299 RD

(56) References Cited

U.S. PATENT DOCUMENTS 4,043,319 A * 8/1977 Jensen ..... 126/299 D
4,089,327 A * 5/1978 Welsh ..... 126/299 D
4,467,782 A * 8/1984 Russell ..... 126/299 D
4,475,534 A * 10/1984 Moriarty ..... 126/299 D
4,557,184 A * 12/1985 Orii et al. ..... 454/60
4,856,419 A * 8/1989 Imai ..... 454/49
5,220,910 A * 6/1993 Aalto et al. ..... 126/299 R
5,282,770 A 2/1994 Shibata ..... 454/239
5,467,761 A * 11/1995 Kuechler ..... 126/299 D
5,906,195 A * 5/1999 Georgaras ..... 126/299 D

FOREIGN PATENT DOCUMENTS

| | | |
|---|---|---|
| JP | 04-082535 | 7/1992 |
| JP | 06-074507 | 3/1994 |
| JP | 08-094140 | 4/1996 |
| JP | 09-178236 | 7/1997 |
| WO | WO01/77589 | 10/2001 |

* cited by examiner

*Primary Examiner*—Derek S. Boles
(74) *Attorney, Agent, or Firm*—Rader, Fishman & Grauer PLLC

(57) ABSTRACT

The object of the present invention is to provide exhaust air discharging and ventilating technologies capable of completing local ventilation without affecting the habitability and workability.

The invention is a method for locally discharging the air around and near cooking equipment (1) in a kitchen in which cooking equipment (1) that causes air contamination is installed, wherein upward suction draft (16) going out of the room is produced from above the cooking equipment (1), while upward blowout draft (21) is produced from near the side of the cooking equipment (1), and due to the inductive action of the blowout draft (21), the contaminated air (30) around and near the cooking equipment (1) is forcibly caught and carried into the blowout draft (21).

21 Claims, 8 Drawing Sheets

LOCAL EXHAUSTING AND VENTILATING METHODS, AND LOCAL EXHAUSTING DEVICE AND LOCAL VENTILATING SYSTEM

TECHNICAL FILED

The present invention relates to a method of local ventilation, a ventilation method, a local ventilator, and a ventilating system, and more particularly to local ventilating and ventilating technologies which are effective when a contaminant that causes air contamination is released from a specific indoor portion, and the contaminated air is heat draft, steam, odor, tobacco smoke, lamp soot, or dusty air that is not harmful to human body, in all indoor spaces necessary to be ventilated such as factories, kitchens, smoking rooms, and bathrooms.

BACKGROUND ART

Generally, indoor spaces such as factories, kitchens, smoking rooms and bathrooms, where there exists a point of release of a contaminant that causes air contamination, must be provided with ventilation for cleaning the indoor atmosphere.

In this case, as a method of ventilating indoor spaces in which the contaminated air released is heat draft, steam, odor, tobacco smoke, lamp soot, or dusty air that may not endanger lives, generally employed is a so-called overall ventilation system which is arranged that the whole air in the room is replaced while the contaminated air is in a state of being mixed and diluted in the indoor atmosphere.

As an overall ventilation system, there are three types of systems such as a system using mechanical power for both air intake and discharge, a system using mechanical power for air intake only, while discharging the exhaust air from an exhaust hole in a spontaneous fashion, and a system using mechanical power for discharging the air only, while taking in the air from an air intake port in a spontaneous fashion. Usually, however, a mechanical ventilation system using suction draft created by mechanical power is mainly employed.

Regarding the legal standards related to ventilating apparatuses for general buildings, the amount of ventilation is specified for the purpose of assuring safety and sanitation aiming at humans according to the result of calculation from the allowable concentration of indoor carbonic acid gas, and for the purpose of assuring the amount of oxygen necessary for combustion in a room where a fire is used. Actually, however, there are no clear standards based on true technology and performance. And, in the technical field or industry of buildings at present, to install an inexpensive ventilating system without spending much money, which just meets the requirements of the legal standards related to ventilating apparatuses, is a common method widely employed.

A general ventilating system for rooms that require reasonable habitability and workability, for example, a ventilating system for kitchens is arranged, as shown in FIG. 8, having a configuration of an overall ventilation system for ventilating the entire room of the kitchen such that combustion heat type cooking equipment a, the point of release of contaminant, is installed near the room wall.

That is, in the ceiling above the cooking equipment a is provided suction hole c of exhaust duct b, and also an exhaust duct fan (not shown) is disposed at the outdoor end portion of the exhaust duct b. Also, exhaust hood e for catching the contaminated air made up of heat jet d of the contaminant generated due to combustion heat of the cooking equipment a is connected to the suction port c in order to prevent the diffusion of the contaminated air. On the other hand, in the ceiling at the center of the room, remote from the cooking equipment a, is disposed air intake port h of air intake duct g provided with air box f, and also air conditioner i is installed near there. Further, exhaust duct k provided with exhaust ceiling fan j is disposed on the ceiling near opening m remote from the cooking equipment a.

And, the heat jet d of the contaminant generated due to combustion heat of the cooking equipment a is caught by the exhaust hood e and collected into the exhaust duct b from the suction port c as the exhaust duct fan of the exhaust duct b is operated, and then it is discharged out of the room, while the room air at the portion remote from the cooking equipment a is discharged out of the room through the exhaust duct k disposed near the opening m as the exhaust ceiling fan j is operated. On the other hand, from the air intake port h at the center of the ceiling, outside fresh air is taken in through the air box f of the air intake duct g as an intake duct fan (not shown) is operated, while fresh air also spontaneously flows into the room from the window (opening) m of the kitchen. In this way, the entire room of the kitchen is ventilated.

However, in such an overall ventilation system, there arise many problems as mentioned in the following, and there has been a demand for their improvements.

That is, as represented by kitchens, when an overall ventilation system is employed for a room in which a lot of contaminant is released, the amount of ventilation becomes very large and it will worsen the efficiency of ventilation, and also, the state of the air in the room becomes identical with that of the outside air because a large volume of atmospheric air is taken into the room.

Further, in ventilation based on suction draft with use of mechanical power, it is unable to effectively discharge only the contaminant because of poor controllability, and it will cause the heat, steam, lamp soot, odor, fume or the like to be detained in the room, and then the room air condition comes to the worst.

For example, in the case of kitchens, the ventilating air volume and air conditioning capacity required will become very large if intended to satisfy the kitchen temperature and humidity conditions, that is, the standards of HACCP (Hazard Analysis and Critical Control Point) system.

And, the considerable increase of ventilating air volume and air conditioning capacity means that the capacities of ventilating and air conditioning apparatuses are increased resulting in increase of the initial cost and running cost of the ventilating and air conditioning apparatuses.

Also, the increase of the equipment capacities of ventilating and air conditioning apparatuses means that the electric capacity of the equipment is totally increased and such increase in the amount of energy used will invite the increase of the generation of global warming gas such as CO and $CO_2$.

In this respect, it is possible to employ a ventilating system for special purposes as mentioned below as a ventilating system for rooms that require reasonable habitability and workability, such as a ventilating system for kitchens.

That is, in factory ventilation, since the legal standards are very strict because of generation of contaminants harmful to human body, a method of partial or local ventilation by using a draft chamber is employed as an effective method in which the point of release of harmful contaminant is surrounded by partitions and the worker performs the work by inserting the hands through the partitions.

Further, in case the work does not allow the use of such draft chamber, a so-called push-pull uniform flow system is employed as an effective method of local ventilation. In a local ventilation method by this push-pull uniform flow system, the point of release of the contaminant is wrapped up with the uniform flow of blowout (push) draft and suction (pull) draft, and thereby, the air balance is locally completed.

On the other hand, as an overall ventilation system for ventilating a large space such as a parking garage, a so-called delivent ventilation system using an inductive action is also available. In this delivent ventilation system, a plurality of small fans which guide and deliver the contaminated air of the room to the exhaust port, corresponding to the suction exhaust, are installed in good order. By this ventilating system, it is possible to shorten the extension distance of the duct and also to efficiently perform the ventilation.

However, even in such a local ventilation system effective for special purposes, and an overall ventilation system, there will arise other problems as mentioned below if employed as a ventilating system for rooms that require reasonable habitability and workability, and therefore, they have not yet been materialized.

That is, in a local ventilation method by using a draft chamber, the point of release of the contaminant is surrounded by partitions, and there is no fear of leakage of the contaminated air into the room, but the workability will extremely worsen because getting things in and out of the working place can be done only through the door.

Also, in the case of a local ventilation method by a push-pull uniform flow system, since the blowout draft and suction draft are balanced with each other in speed and volume with respect to the entire ambient space, the bore diameters of the blowout port and the suction port become larger, and at the same time, the volume of air becomes very large. Also, from the workability point of view, the worker gets in the uniform draft, and in the case of a kitchen, unlike the above suction port, disposing a blowout port at the lower position will not only affect the workability but also result in remaining of a problem in terms of sanitation.

Further, a method of ventilation by a delivent ventilation system is not a method of local ventilation but a method of overall ventilation, in which the contaminated air is guided in the direction of ventilation, supposing that the car exhaust is accumulated and detained at the ceiling of the parking garage, and as a result, it is possible to improve the ventilating efficiency but unable to reduce the volume of air. Also, the level of noise is very high because many small delivent fans are installed on the ceiling.

The present invention is intended to solve such conventional problems, and the object of the invention is to provide ventilation technology with which local ventilation may be completed without affecting the habitability and workability.

Also, another object of the present invention is to reduce the amount of ventilation and the air conditioning capacity, that is, to provide ventilation technology with which it is possible to reduce the initial cost and the running cost of the ventilating and air conditioning equipment by avoiding a waste of electric energy and decreasing the equipment capacity, and consequently, to decrease the generation of global warming gas.

DISCLOSURE OF THE INVENTION

In order to achieve the above purpose, the local ventilation method of the present invention is a method of locally discharging the air around and near the point of release of the contaminated air, which is characterized in that upward suction draft going out of the room is produced from a position above the point of release of the contaminant, while upward blowout draft is produced from a position near the side of the point of release of the contaminant, and due to the inductive action of the blowout draft, the contaminated air around and near the point of release of the contaminant is forcibly caught and carried into the above blowout draft.

Also, the ventilation method of the present invention is a method of ventilating a room where there exists the point of release of a contaminant that causes the air to be contaminated, which is characterized in that the local ventilation method is applied to the point of release of the contaminant in order to establish the balanced ventilation of the room.

As a preferred embodiment, auxiliary blowout draft that passes so as to wrap up the point of release of the contaminant is produced from a portion around the ventilating zone to which the local ventilation method is applied, and the contaminant generated from the point of release of the contaminant is forcibly caught and carried into the upward uniform draft formed by the blowout draft and the suction draft.

Also, the local ventilator of the present invention is preferably employed for the execution of the local ventilation method, comprising a suction draft producing means for producing upward suction draft going out of the room, with a suction port provided above the point of release of the contaminant, and a blowout draft producing means for producing upward blowout draft, with a blowout port provided in a position close to the side of the point of release of the contaminant, and due to the inductive action of the blowout draft produced by the blowout draft producing means, the contaminated air around and near the point of release of the contaminant is forcibly caught and carried into the blowout draft.

As a preferred embodiment, the blowout port of the blowout draft producing means is disposed facing upward at a position near the side of the point of release of the contaminant isolated from the working position of the worker. Also, preferably, a draft rectifying means for preventing the diffusion of blowout draft produced by the blowout draft producing means is disposed at a position below the suction port of the suction draft producing means. Further, a blowout port is disposed at a position above the point of release of the contaminant, which comprises an auxiliary blowout draft producing means for producing downward auxiliary blowout draft that passes so as to wrap up the point of release of the contaminant.

Further, the ventilating system of the present invention comprises the local ventilator to cope with the point of release of contaminant and is characterized in that the ventilation of the room is balanced due to the configuration.

As a preferred embodiment, there is provided a blowout port at a position around the ventilating zone of the local ventilator, which comprises an auxiliary blowout draft producing means for producing auxiliary blowout draft that passes so as to wrap up the point of release of the contaminant.

In the local discharge and ventilation of the present invention, highly controllable upward uniform draft, passing around and near the point of release of contaminant that causes the air to be contaminated, is created by the suction draft and the blowout draft, and at the same time, due to the inductive action of the blowout draft, the contaminated air around and near the point of release of the contaminant is forcibly caught and carried into the blowout draft.

In this way, the local discharge and ventilation can be completed, without wrapping up the point of release of the contaminant, as the upward uniform draft that forcibly discharges the contaminated air passes around and near the point of release of the contaminant. As a result, there will be no interference with the operation of the worker nor hindrance to the habitability and workability.

Also, by completing the local discharge and ventilation, it becomes possible to reduce the amount of ventilation and the air conditioning capacity, and as a result of keeping the capacity of ventilating and air conditioning equipment at a low level, it is possible to decrease the initial cost and running cost of the ventilating and air conditioning equipment, and also to reduce the consumption of electric energy, thereby enabling the reduction of the generation of global warming gas.

BRIEF DESCRIPTION OF THE DRAWINGS

FIG. 3(*a*) is a schematic plan view showing the positional configuration of a blowout port. FIG. 3(*b*) is a plan view showing a remodeled example of an opening shape of a blowout port.

FIG. 7(*a*) is a perspective view showing a rectifying hood that is a component thereof. FIG. 7(*b*) is a front view showing the enlarged configuration of the draft rectifying section.

DETAILED DESCRIPTION OF PREFERRED EMBODIMENTS

The preferred embodiments of the present invention will be described in detail in the following with reference to the drawings.

Preferred Embodiment 1

Figure 1:
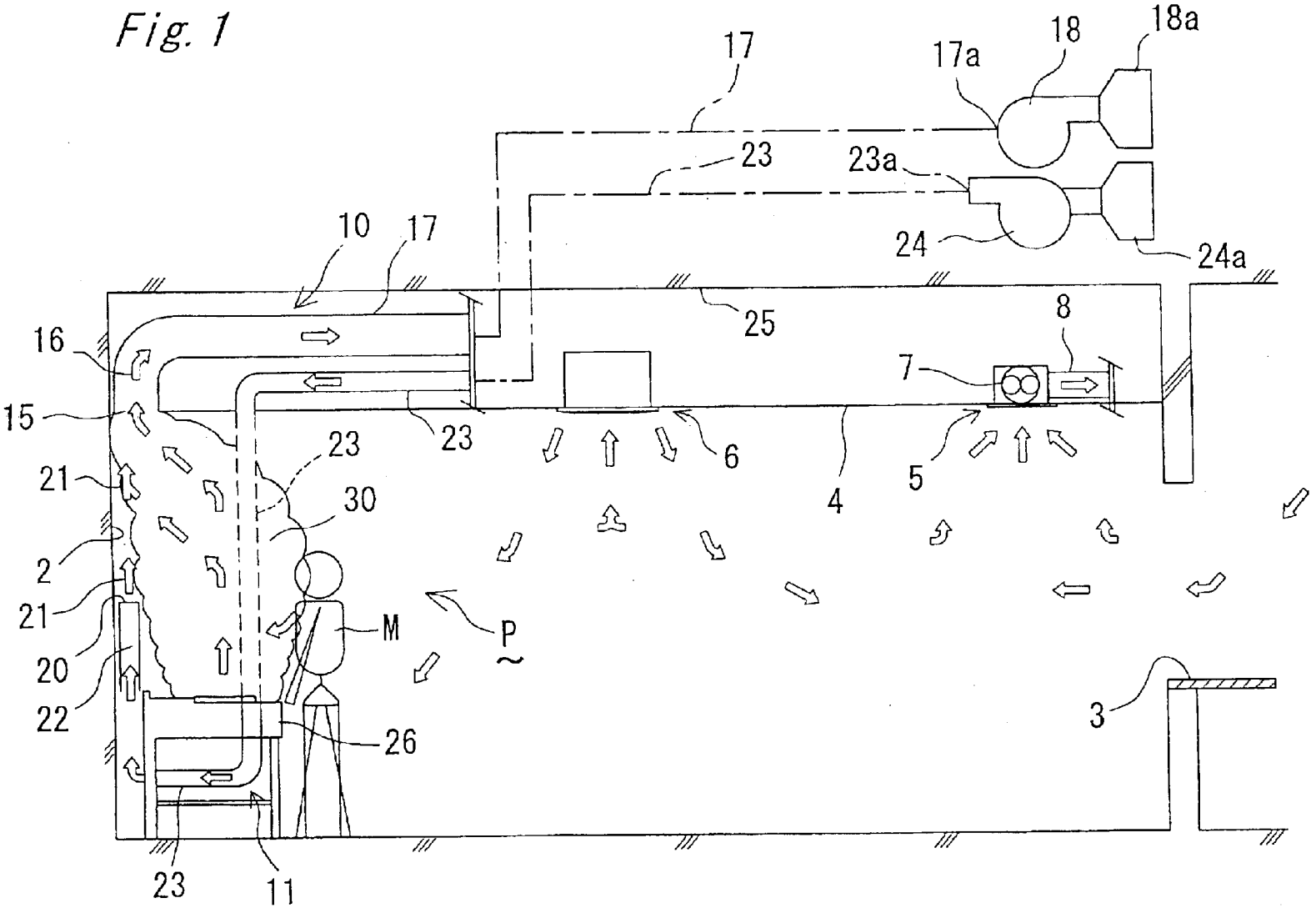
FIG. 1 is a schematic diagram showing a kitchen ventilating system provided with a local ventilator in the preferred embodiment 1 of the present invention.
Figure 2:
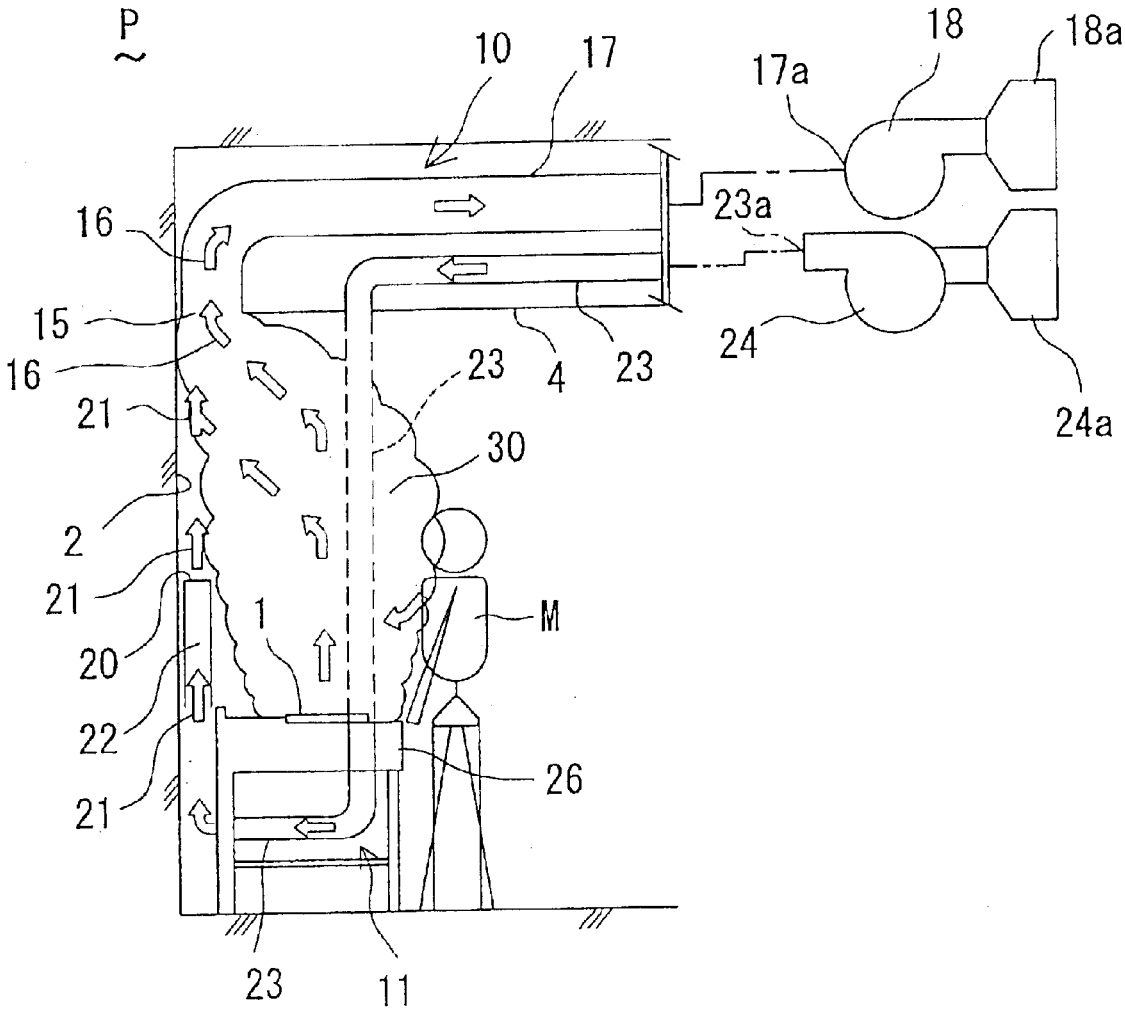
FIG. 2 is a schematic diagram showing the local ventilator of the ventilation system.

A ventilating system related to the present invention is shown in FIG. 1. This ventilating system is used for ventilating rooms, specifically for kitchens, which must have reasonable habitability and workability, and is based on an overall ventilation system for ventilating the entire room of the kitchen, and comprises an local ventilator P as an essential component as shown in FIG. 2.

In this ventilating system, for example, when combustion heat type cooking equipment 1 such as a table cooking stove is arranged close to room wall 2, the local ventilator P is disposed against the combustion heat type cooking equipment 1. Also, there is provided a conventional common type ventilator 5 is installed on ceiling 4 near opening 3 connected to the next room remote from the cooking equipment 1, and also, air conditioner 6 is disposed on the ceiling 4 at the center of the room. The ventilator 5 has a basic structure that is conventionally well known, and one end of exhaust duct 8 provided with ceiling exhaust fan 7 is opened facing the room from the ceiling 4, while the other end (not shown) is opened facing the outside of the room.

The local ventilator P comprises suction draft producing section (suction draft producing means) 10 and blowout draft producing section (blowout draft producing means) 11 as main components.

The suction draft producing section 10 has a structure such that suction port 15 is disposed above the cooking equipment 1, which produces upward suction draft 16 going out of the room. The suction draft 16 mainly functions as suction draft that sucks up contaminated air 30 containing the contaminant released from the cooking equipment 1.

Specifically, at the ceiling 4 above the cooking equipment 1, one end of the exhaust duct 17 is opened facing the room, functioning as the suction port 15, while the other end 17*a* of the exhaust duct 17 is opened facing the outside of the room, and this outdoor end 17*a* is provided with exhaust fan 18 having exhaust port 18*a*. In the preferred embodiment shown, the suction port 15 is not provided with a means for catching the exhaust such as an exhaust hood, but it is preferable to install an exhaust hood or the like as needed.

The blowout draft producing section 11 has a structure such that blowout port 20 is disposed at a position near the side of cooking equipment 1, which produces upward blowout draft 21.

Specifically, a blowout nozzle 22 having blowout port 20 is disposed upright at the position of room wall 2 near the side of the cooking equipment 1, and the blowout nozzle 22 is communicated to the outside of the room via air intake duct 23, and also, air intake fan 24 having intake port 24*a* is disposed at the outdoor end 23*a* of the air intake duct 23.

The piping passage of the air intake duct 23, that is, the blowout draft passage, first horizontally extends from outside the room, as shown, in the space between the ceiling 4 and the top slab 25 of the kitchen, and then perpendicularly goes down in the room wall (not shown). After that, it passes through the casing of cooking equipment 1 or kitchen table 26 and extends to the blowout port 20 of the blowout nozzle 22. Thus, the casing 26 is internally air-cooled, and thereby, the cooking equipment 1 itself is effectively heat-insulated.

Also, the position of the blowout port 20 is decided so as not to interfere with the working range of cook M who is the worker. Specifically, at a position near the side of the cooking equipment 1 remote from the working position of the cook M, for example, at the position of FIG. 3(*a*), there is provided the blowout port 20 facing upward at one portion or a plurality of portions shown by $p_1$~$p_4$ or $p_5$~$p_7$.

In the preferred embodiment shown, it is disposed at two portions $p_1$ and $p_2$ against two pieces of cooking equipment 1, 1, that is, at positions opposite to the working position of the cook M with the cooking equipment 1 therebetween and being close to the room wall 2.

Correspondingly, the suction port 15 of the suction draft producing section 10 is arranged so as to be vertically aligned to the position of the blowout port 20.

And, when the exhaust fan 18 of the suction draft producing section (suction draft producing means) 10 is operated, upward suction draft 16 going into the suction port 15 is produced, and when the air intake fan 24 of the blowout draft producing section 11 is operated, upward blowout draft 21 linearly extending to the suction port 15 from the blowout port 20 of the blowout nozzle 22 is produced, and moreover, these drafts 16 and 21 are coaxially formed.

In this way, it is configured that upward uniform draft formed by these drafts 16 and 21 passes around and near the cooking equipment 1, and also, due to the inductive action of the blowout draft 21, contaminated air 30 around and near the cooking equipment 1, including the heat jet of contaminant generated due to the combustion heat of the cooking equipment 1, is forcibly caught and carried into the suction draft 16. The suction draft 16 that has received the contaminated air 30 is discharged out of the room through the exhaust duct 17.

Figure 3A:
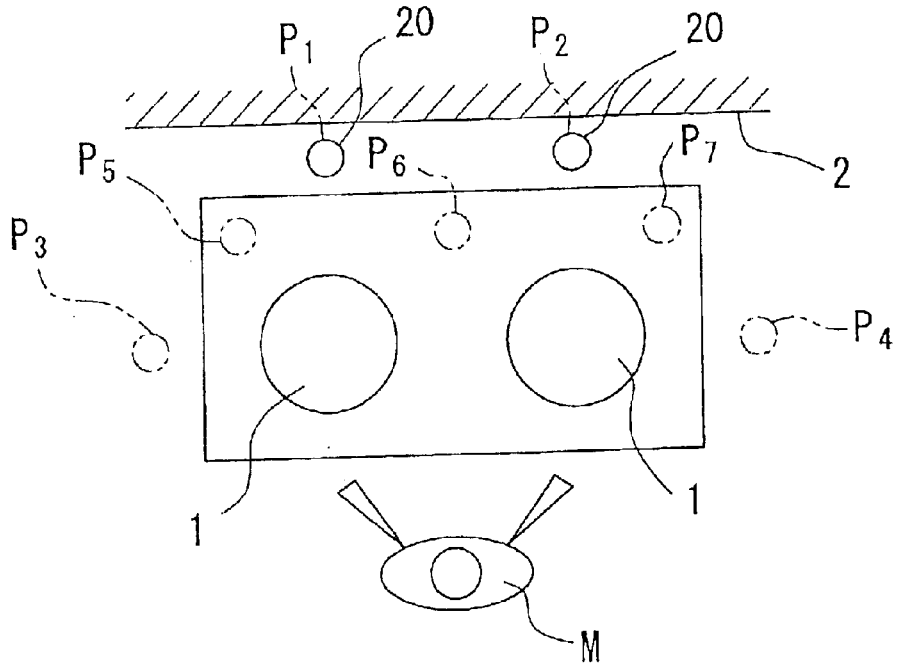
FIG. 3 shows the configuration of a blowout port of a blowout draft producing section in the local ventilator.
Figure 3B:
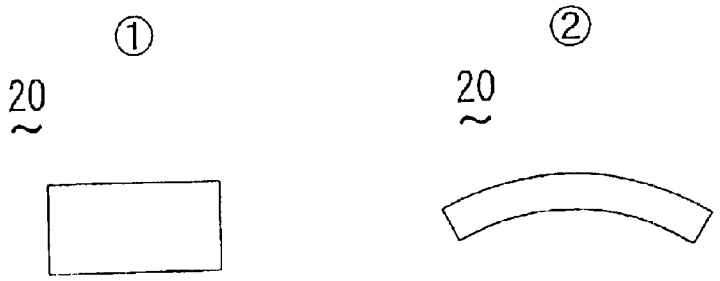

The opening shape of the blowout port 20 is circular as shown in FIG. 3(*a*), and also, for example, it is possible to properly employ a rectangular shape (see (1)) or fan-like shape (see (2)) as shown in FIG. 3(*b*), taking into account the positional relation with the cooking equipment 1 and the opening shape of the suction port 15.

Next, the conditions for setting the balance of entire kitchen ventilation including the exhaust air discharging action of the local ventilator P will be described. In the present preferred embodiment, the balance of ventilation is established for the entire room of the kitchen by applying the local ventilator P to the cooking equipment 1.

Specifically, the air volume of suction draft 16 produced by the suction draft producing section 10 of the local ventilator P is set by adding the air volume of blowout draft 21 produced by the blowout draft producing section 11 and the volume of air, around the cooking equipment 1, induced by the blowout draft 21, and thereby, the balance of ventilation is established for the entire room of the kitchen. In this case, the suction draft 16 is discharged, while the intake air covers the blowout draft 21 produced by the blowout draft producing section 11 and the draft to be induced.

In this connection, the blowout air volume of the blowout draft producing section 11 is set to be less than the suction air volume of the suction draft producing section 10.

In this case, the suction air volume is decided from the suction face wind-velocity and the induced air volume, and in the present preferred embodiment, since the suction port 15 is not provided with an exhaust hood or the like, the suction face wind-velocity is the duct wind-velocity of the exhaust duct 17.

Also, the blowout face wind-velocity of the blowout draft 21 is identical with the suction face wind-velocity of the suction draft 16. Therefore, the suction draft 16 and the blowout draft 21 are same in wind-velocity and uniformly flows in the same direction, which are different only in air volume, and upward uniform draft passing around and near the cooking equipment 1 is locally formed.

Thus, in a ventilating system having a configuration as described above, contaminated air 30 including the heat jet of contaminant generated due to the combustion heat of cooking equipment 1 is forcibly induced and caught by the upward uniform draft (made up of suction draft 16 and blowout draft 21) formed so as to pass around and near the cooking equipment 1 when the exhaust fan 18 of the local ventilator P and the air intake fan 24 are operated, and is collected from the suction port 15 into the exhaust duct 17 and is discharged out of the room.

On the other hand, the room air at portions remote from the cooking equipment 1 is discharged out of the room through the exhaust duct 8 when the ceiling exhaust fan 7 of the ventilator 5 is operated. Correspondingly, fresh air spontaneously flows in through the opening 3.

Figure 8:
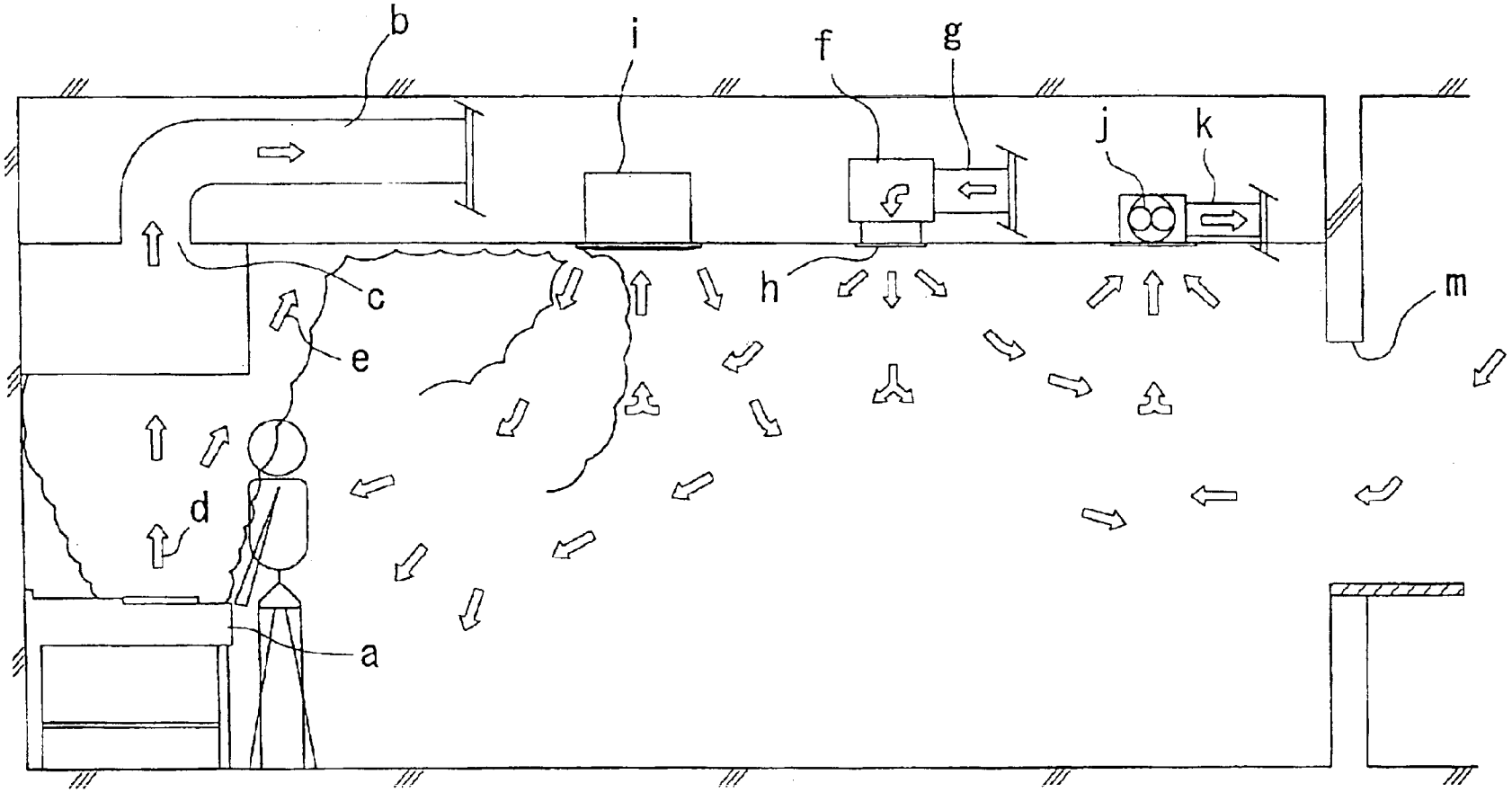
FIG. 8 is a schematic diagram showing a conventional ventilating system for kitchens.

As the ventilating system operates in this way, local ventilation as described above is completed in the ventilating zone of the local ventilator P, and then the flow of the air in this zone is arranged in a state of being divided into intake air and exhaust air as shown in FIG. 1 and FIG. 2 unlike in a conventional overall ventilation system shown in FIG. 8 where the drafts are in a state of being mixed with each other.

Consequently, the heat and atmospheric air causing influences to the circulated draft of air conditioner 6 are in a state of remaining same as in an ordinary room, and also, the general ventilation in the kitchen, that is, the ventilation by the operation of ventilator 5 is executed for indoor spaces other than the ventilating zone covered by the operation of the local ventilator P, and the amount of ventilation is kept at a low level almost equivalent to that for an ordinary room.

In other words, as a result of completing the local ventilation by the local ventilator P, it is possible to reduce the ventilating and air conditioning capacities for the entire room of the kitchen.

As a result, by lowering the capacities of the ventilating and air conditioning apparatuses, it is possible to decrease the initial cost and the running cost of the ventilating and air conditioning equipment and also to reduce the generation of global warming gas because of lessening the consumption of electric energy.

Moreover, the local ventilation can be completed without wrapping up the cooking equipment 1 as the upward uniform draft for forcibly discharging the contaminated air 30 passes around and near the cooking equipment 1 that is the point of release of the contaminant, and as a result, there is no interference with the working operation of cook M, causing no hindrance to the habitability and workability.

Preferred Embodiment 2

Figure 4:
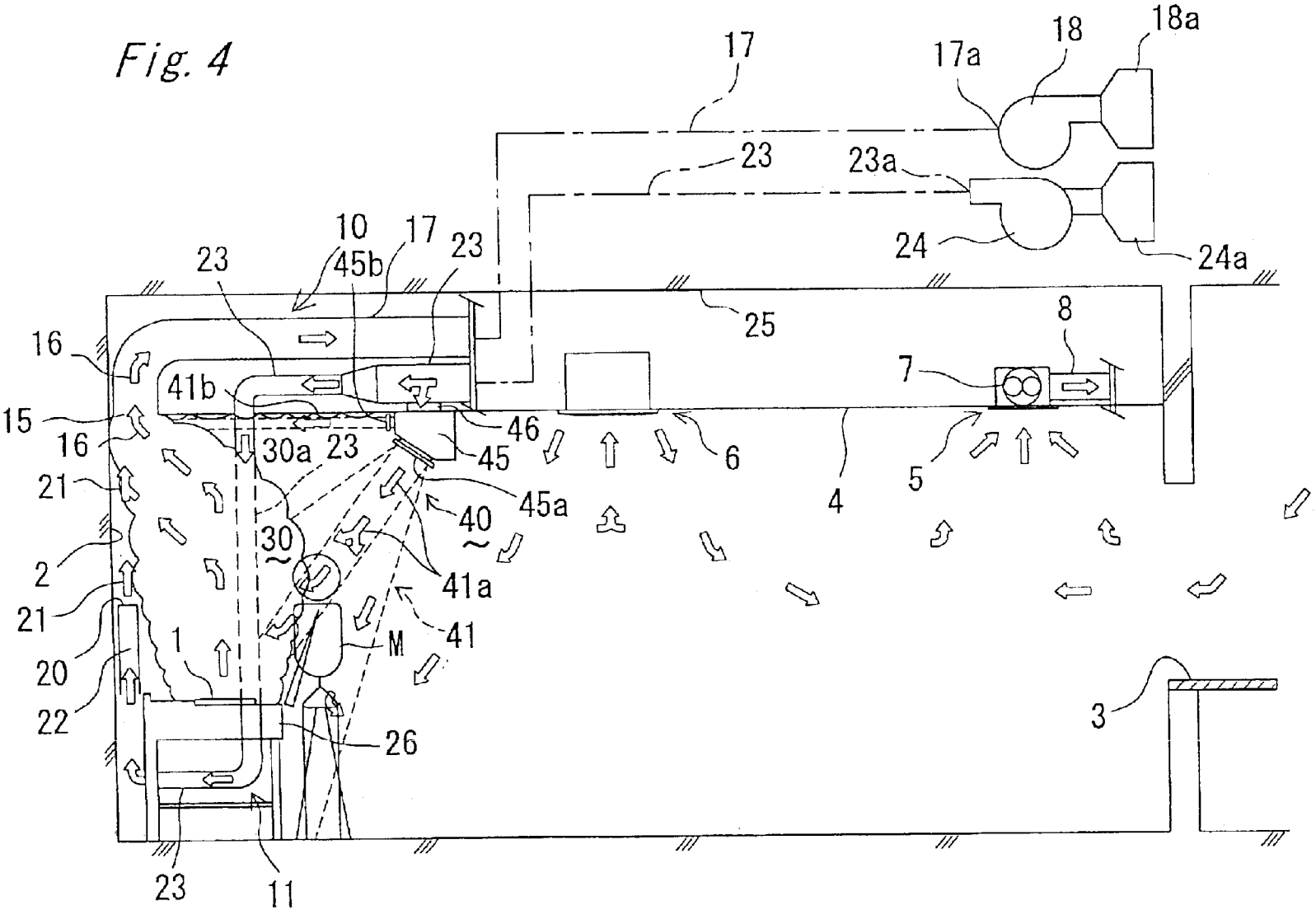
FIG. 4 is a schematic diagram showing a kitchen ventilating system provided with a local ventilator in the preferred embodiment 2 of the present invention.
Figure 5:
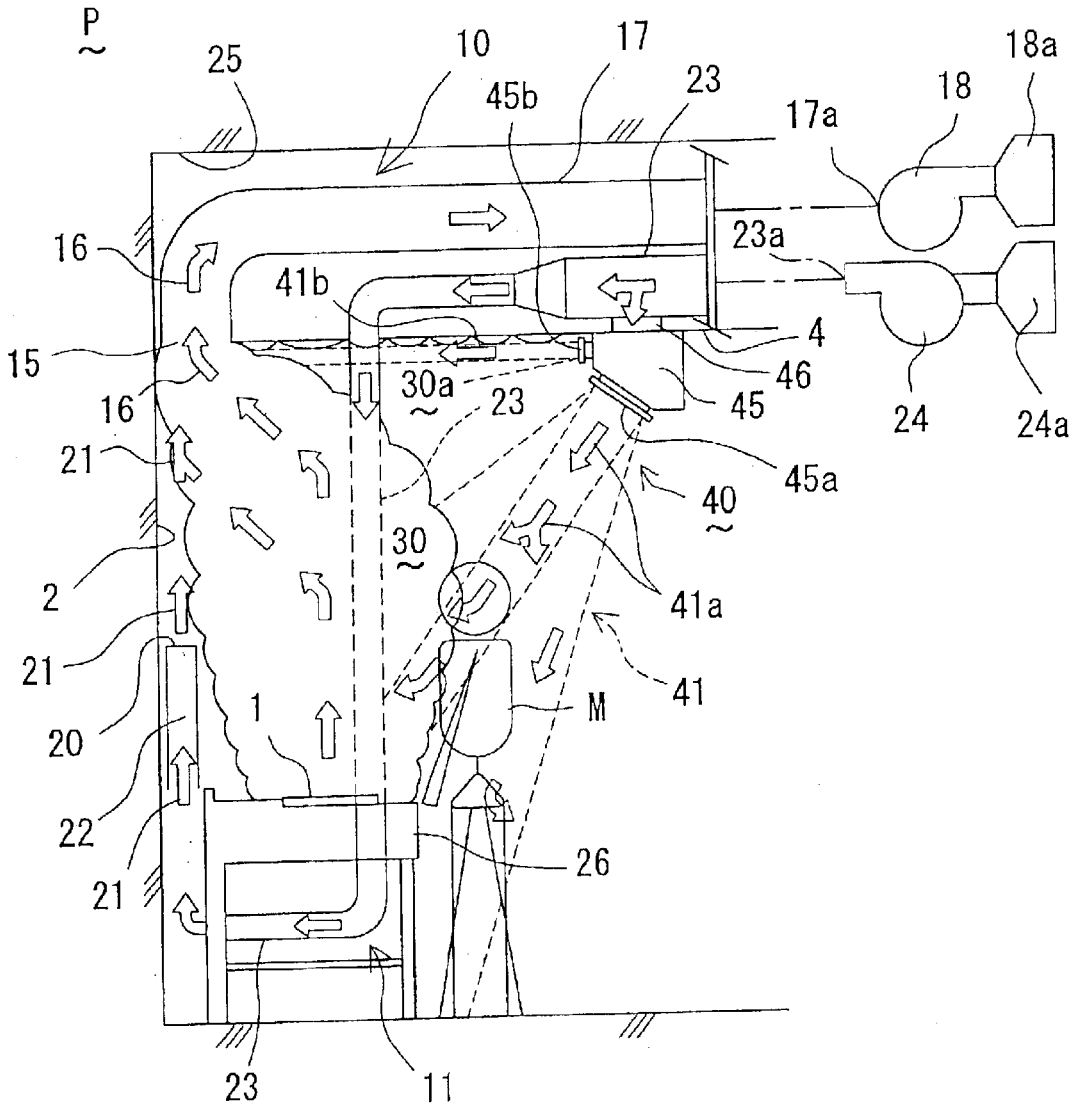
FIG. 5 is a schematic diagram showing the local ventilator of the ventilating system.

This preferred embodiment is shown in FIG. 4 and FIG. 5. The ventilating system of the preferred embodiment 1 is improved in this embodiment with respect to some configuration.

That is, the ventilating system of the present preferred embodiment has a configuration that is suitable to be used when a relatively large quantity of contaminated air 30 is generated due to the combustion heat of cooking equipment 1. Specifically, there is provided an auxiliary blowout draft producing section 40 at a position outside the ventilating zone of the local ventilator P.

The auxiliary blowout draft producing section 40 produces downward auxiliary blowout draft 41 that passes so as to wrap up the cooking equipment 1, the point of release of the contaminant, and comprises blowout box 45 as main component disposed around the ventilating zone of the local ventilator P.

The blowout box 45 shown is disposed on the ceiling 4 around the ventilating zone of the local ventilator P, which is communicated with the intake air duct 23 of the local ventilator P via branch duct 46, and uses the power source, intake air fan 24, that is also used by the local ventilator P.

The blowout box 45 comprises two blowout ports 45*a* and 45*b*, and the blowout port 45*a* is opened horizontally facing the ventilating zone of the local ventilator P, while the blowout port 45*b* is opened in a state of being obliquely downward in the direction of the cooking equipment 1.

Thus, in a ventilating system comprising the auxiliary blowout draft producing section 40 as described above, besides the ventilation in the preferred embodiment 1, auxiliary blowout draft 41*a* that passes so as to wrap up the cooking equipment 1 is produced from the blowout ports 45*a*, 45*b*, particularly from the downward blowout port 45*a*, of the blowout box 45 at an upper portion around the ventilating zone of the local ventilator P, and the contaminated air 30 released from the cooking equipment 1 is forcibly induced, caught and carried into the upward uniform draft created by the blowout draft 21 and suction draft 16 of the local ventilator P.

More specifically, the blowout draft 41*a* from the downward blowout port 45*a* of the blowout box 45 becomes downward blowout draft that passes so as to wrap up the whole surrounding portion including the cooking equipment 1, and mainly serves to prevent the leakage of heat, odor, steam, harmful gas, fume or the like contained in the contaminated air 30 generated due to the combustion of the cooking equipment 1 while positively carrying them in the direction of blowout draft 21. On the other hand, the blowout draft 41*b* from the horizontal blowout port 45*b* of the blowout box 45 mainly serves to positively carry the contaminated air 30*a*, drifting and being diffused along the ceiling 4, in the direction of the suction draft 16 or blowout draft 21 of the local ventilator P. Consequently, the partial ventilation will be more complete than in the preferred embodiment 1.

Preferred Embodiment 3

Figure 6:
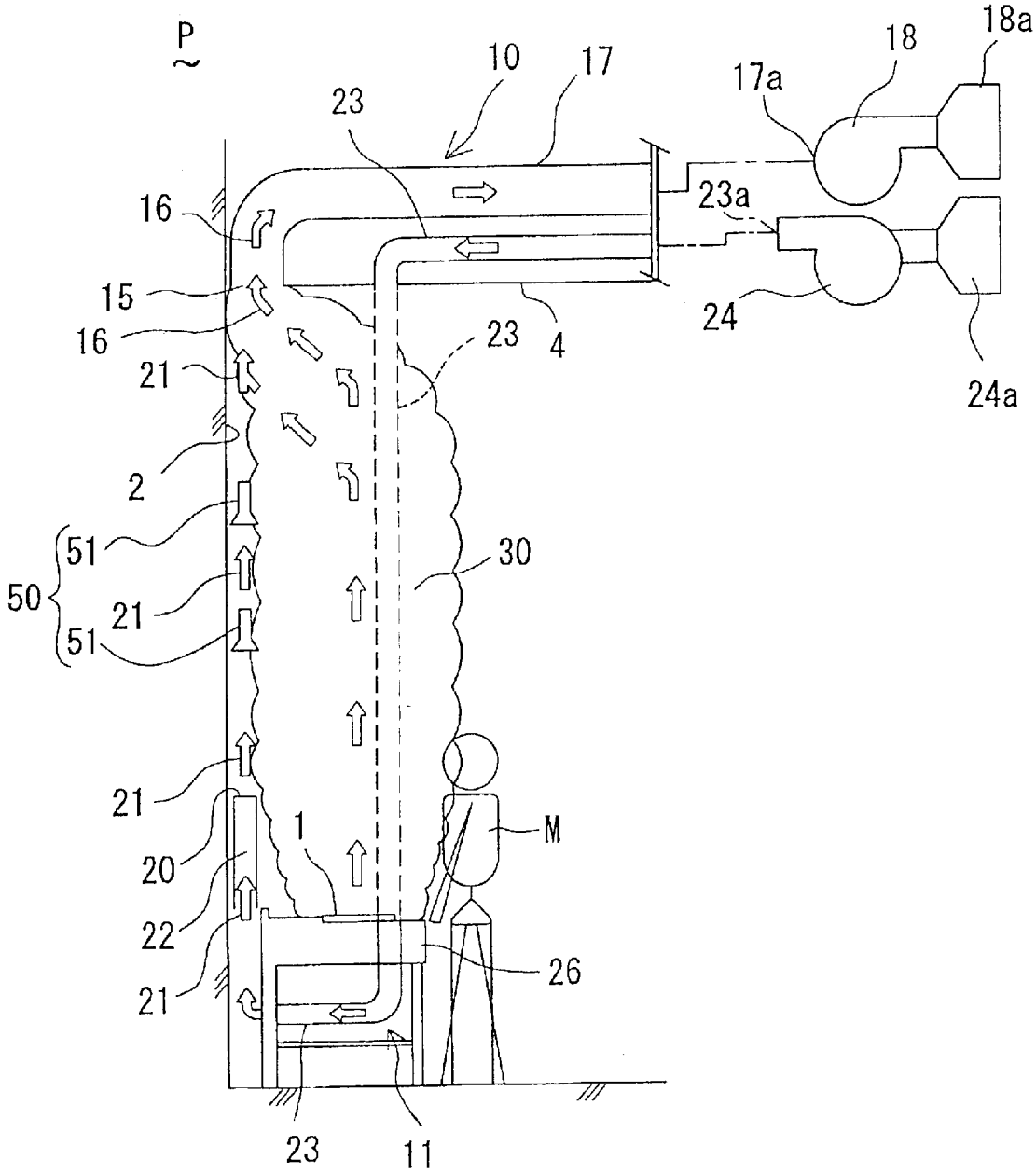
FIG. 6 is a schematic enlarged view showing the configuration of an essential portion of a local ventilator in the preferred embodiment 3 of the present invention.
Figure 7A:
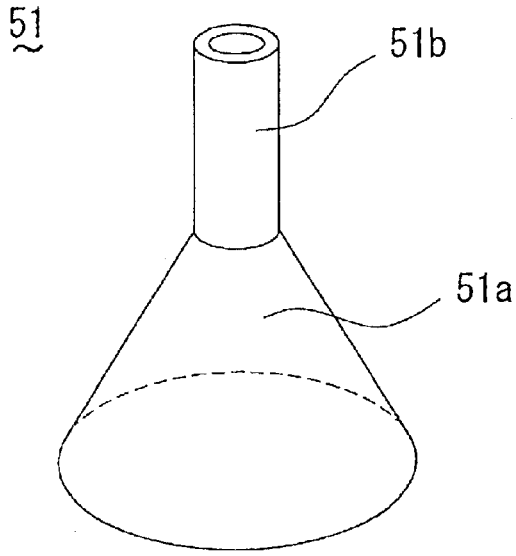
FIG. 7 shows a draft rectifying section of the local ventilator.
Figure 7B:
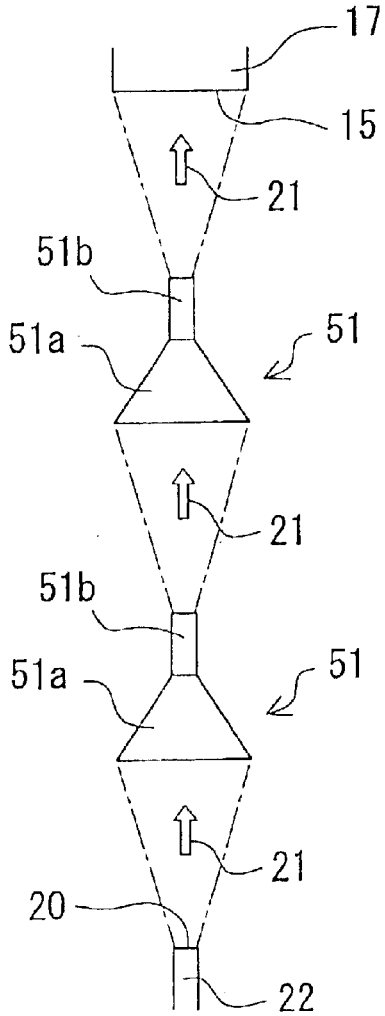

This preferred embodiment is shown in FIG. 6 and FIG. 7. The local ventilator P of the preferred embodiment 1 is improved in this embodiment with respect to some configuration.

That is, the local ventilator P of the present preferred embodiment has a configuration that is suitable to be used when the distance is relatively long between the suction port 15 of suction draft producing section 10 and the blowout port 20 of blowout draft producing section 11. Specifically, there is provided a draft rectifying section (draft rectifying means) 50 at a position below the suction port 15.

The draft rectifying section 50 serves to prevent the diffusion of blowout draft 21 coming from the blowout port 20. Specifically, it comprises at least one rectifying hood 51. The draft rectifying section 50 shown includes two rectifying hoods 51, 51 which are coaxially arranged along the passage of the blowout draft 21.

The rectifying hood 51 is, as shown in FIG. 7(*a*), structurally such that cylindrical pipe 51*b* is integrally connected to the downwardly disposed apex of conical hood body 51*a*.

It is desirable to set the shape and size of the bottom brim of the hood body 51*a* in accordance with the diffusion shape of the blowout draft 21 from the blowout port 21. In the figure, since the opening of blowout port 20 is circular, the diffusion shape of blowout draft 21 is theoretically similar to a conical shape, and accordingly, the bottom brim of hood body 51*a* is also circular in shape, but the shape is of course not limited to this.

Also, the rectifying hood 51 is arranged in a position where upward blowout draft 21 may be completely caught by the hood body 51*a*. That is, in the present preferred embodiment, as shown in FIG. 7(*b*), the lower rectifying hood 51 is arranged in a position where the blowout draft 21 from the blowout port 20 is completely caught by the hood body 51*a*, while the upper rectifying hood 51 is arranged in a position where the blowout draft 21 from the cylindrical pipe 51*b* of the lower rectifying hood 51 is completely caught by the hood body 51*a*.

Thus, in the local ventilator P having a configuration as described above, as compared with the case of the preferred embodiment 1, when the distance is relatively long between the suction port 15 and the blowout port 20, in other words, even when the ceiling is very high as in a hotel kitchen, upward uniform draft is precisely formed by the blowout draft 21 and the suction draft 16.

That is, under the condition of the above arrangement, by properly increasing and decreasing the number of the rectifying hoods 51 which together make up the draft rectifying section 50, it is theoretically possible to create uniform draft in best condition whatever the distance is between the suction port 15 and the blowout port 20.

Also, the passage of uniform draft formed between the suction port 15 and the blowout port 20 can be made in a curved line shape, instead of a linear line shape as in the preferred embodiment shown, by selecting the position or angle of the rectifying hood 51.

And, by forming uniform draft in such curved line shape, it is also possible, for example, to set up the local ventilator P wherein the suction draft 16 of suction port 15 and the blowout draft 21 of blowout port 20 are not aligned to each other.

In the above description of the preferred embodiment, described is only a preferable embodiment of the present invention. The present invention is not limited to this, and it is possible to change the design in various ways within the scope thereof.

For example, in the preferred embodiment shown, the intake air from outside is used as the blowout draft 21 of the blowout draft producing section 11, but it is also possible to use a configuration such that a blowout fan (not shown) is installed at a position close to the cooking equipment 1 or the position of blowout nozzle 22, thereby producing the blowout draft 21 by the blowout fan.

Industrial Applicability

As described above, according to the present invention, highly controllable upward uniform draft, passing around and near the point of release of the contaminant that causes the air to be contaminated, is produced by suction draft and blowout draft, and due to the inductive action of the blowout draft, the contaminated air around and near the point of release of the contaminant is forcibly caught and carried into the blowout draft. Accordingly, it is possible to provide exhaust air discharging and ventilating technologies capable of completing local ventilation without wrapping up the point of release of the contaminant, causing no interference with the operation of the worker and no adverse effects to the habitability and workability.

Also, by completing local ventilation, it is possible to reduce the amount of ventilation and air conditioning capacity, and as the ventilating and air conditioning capacities are kept at a low level, the initial cost and the running cost of the ventilating and air conditioning apparatuses can be decreased, and at the same time, it is possible to reduce the generation of global warming gas because of lessening the consumption of electric energy.

That is, according to the local ventilating system related to the present invention, local or partial ventilation can be effectively executed when the point of release of a contaminant exists at a specific portion. As compared with a conventional overall ventilation system which replaces the air of the entire room for the purpose of ventilation, it is possible to considerably lower the capacities of the air conditioning and ventilating equipment.

For example, in the case of a kitchen, the following can be mentioned as the advantages to be practically obtained.

a) The initial cost of the air conditioning and ventilating equipment is far lower than that of a conventional overall ventilation system (40% lower as compared with conventional one), and it is easier to satisfy the temperature and humidity standards of HACCP.

b) The running cost of the air conditioning and ventilating equipment is 50% lower as compared with a conventional overall ventilation system, and further, when compared with a conventional overall ventilation system with respect to HACCP, the cost can be reduced as much as 80 to 90%. Thus, the reduction in running cost will greatly contribute to the restaurant industry.

c) Conforming to HACCP, it makes the working environment of the kitchen comfortable, and since a hoodless system without using an exhaust hood that has been conventionally essential can be employed, it is possible to brighten the image of the kitchen to all appearance.

d) Legal measures can be easily taken for the hoodless system.

e) Since the amount of ventilation is decreased, the size of the duct may be reduced resulting in better workability, and besides that heat is not detained at the ceiling surface, it is not necessary to make the kitchen ceiling very high and the opening very large, and consequently, economic effects can be expected from the construction point of view.

f) Since the amount of electric energy consumed can be cut down, it is possible to effectively use the energy. Particularly, while there is a trend of increasing demand for electric power in future, equipment increase for atomic power plants may be effectively suppressed.

g) Avoiding a waste of energy is a great contribution to the protection of global environment. It will be a help to keep the promise of COP3.

h) It is even possible to get the target of temperature 22° C. and humidity 60%, drastically clearing the standards of HACCP requested at present.

i) The working environments of kitchens will be greatly improved.

j) In case the existing equipment is reformed (for renewal), because of allowance for the intake and exhaust air volumes, it is possible to re-use the existing main duct, and even when combustion heat type apparatuses are increased, there will be a higher possibility of being able to re-use the duct, intake and exhaust fan, and also due to allowance for the electric capacity, it will be effective as a method of renewal.

What is claimed is:

1. A method of local discharge of a room having a point of release of a contaminant that causes air contamination, the method intended for locally discharging the air around and near said point of release of the contaminant comprising the steps of, producing an upward suction draft exiting the room from above said point of release of the contaminant, simultaneously producing an upward blowout draft from above and near a side of said point of release of the contaminant, and due to the inductive action of the blowout draft, forcibly catching and carrying into said blowout draft the contaminated air around and near said point of release of the contaminant.

2. The method of local discharge of claim 1, wherein an upward uniform draft passes around and near said point of release of the contaminant and is formed by said suction draft and blowout draft.

3. The method of local discharge of claim 1, wherein said suction draft and blowout draft are coaxially formed.

4. The method of local discharge of claim 1, wherein the air volume of said blowout draft is less than the air volume of said suction draft.

5. A ventilation method for ventilating a room having a point of release of a contaminant that causes air contamination comprising the steps of, producing an upward suction draft exiting the room from above said point of release of the contaminant, simultaneously producing an upward blowout draft from above and near a side of said point of release of the contaminant, and due to an inductive action of the blowout draft, forcibly catching and carrying into said blowout draft the contaminated air around and near said point of release of the contaminant, and thereby, air around and near said point of release of the contaminant is locally discharged.

6. The ventilation method of claim 5, wherein an air volume of said suction draft an air volume of said blowout draft and a volume of air around said point of release of the contaminant that is induced by the blowout draft.

7. The ventilation method of claim 5, wherein said suction draft is discharged, while said blowout draft and the induced draft are covered by intake air.

8. The ventilation method of claim 5, wherein auxiliary blowout draft is produced from a portion around a the discharging zone locally discharged, and the contaminant released from the point of release of the contaminant is forcibly caught and carried into upward uniform draft created by said blowout draft and suction draft.

9. A local discharger for a room having a point of release of a contaminant that causes air contamination, the local discharger locally discharging the air around and near said point of release of the contaminant, comprising:

a suction draft producing means for producing upward suction draft exiting the room, with a suction port provided above said point of release of the contaminant, and a blowout draft producing means for producing upward blowout draft, with a blowout port provided in a position above and near the side of said point of release of the contaminant, wherein due to an inductive action of the blowout draft produced by said blowout draft producing means, the contaminated air around and near said point of release of the contaminant is forcibly caught and carried into said blowout draft.

10. The local discharger of claim 9, wherein an upward uniform draft passes around and near said point of release of the contaminant and is formed by suction draft produced by said suction draft producing means and blowout draft produced by said blowout draft producing means.

11. The local discharger of claim 9, wherein the suction port of said suction draft producing means and the blowout port of said blowout draft producing means are vertically aligned to each other.

12. The local discharger of claim 9, wherein the blowout port of said blowout draft producing means is disposed facing upward at a position near the side of said point of release of the contaminant remote from the working position of the worker.

13. The local discharger of claim 12, wherein the blowout port of said blowout draft producing means is disposed at a position opposite to the working position of the worker with said point of release of the contaminant therebetween.

14. The local discharger of claim 12, wherein the blowout port of said blowout draft producing means is disposed at a position close to the room wall.

15. The local discharger of claim 9, wherein the blowout air volume of said blowout draft producing means is set to be less than the suction air volume of said suction draft producing means.

16. The local discharger of claim 9, wherein a draft rectifying means for preventing the diffusion of blowout draft from said blowout draft producing means is disposed at a position below the suction port of said suction draft producing means.

17. A ventilating system for a room having a point of release of a contaminant that causes air contamination, comprising:

a local discharger for locally discharging air around and near said point of release of the contaminant;

said local discharger including a suction draft producing means for producing upward suction draft exiting the room, with a suction port provided above said point of release of the contaminant, and a blowout draft producing means for producing upward blowout draft, with a blowout port provided at a position above and near the side of said point of release of the contaminant; and due to an inductive action of blowout draft produced by said blowout draft producing means, the contaminated air around and near said point of release of the contaminant is forcibly caught and carried into said blowout draft, thereby establishing the balance of ventilation of the room.

18. The ventilating system of claim 17, wherein the suction air volume of said suction draft producing means is set by adding the blowout air volume of said blowout draft producing means and the suction volume of air, around said point of release of the contaminant, induced by the blowout draft of the blowout draft producing means, thereby establishing the balance of ventilation of the room.

19. The ventilating system of claim 17, wherein the suction draft passage of said suction draft producing means is formed extending out of the room from said suction port, and a blowout draft passage of said blowout draft producing means is formed extending from outside the room to said blowout port.

20. The ventilating system of claim 19, wherein the blowout draft passage of said blowout draft producing means is formed extending from outside the room to said blowout port through the casing of said point of release of the contaminant.

21. The ventilating system of any one of claims 17 to 20, comprising an auxiliary blowout draft producing means for producing auxiliary blowout draft that passes so as to wrap up the point of release of the contaminant, with a blowout port provided at a position around the discharging zone of said local discharger.

* * * * *